US005722874A

United States Patent [19]

Horton et al.

[11] Patent Number: 5,722,874

[45] Date of Patent: Mar. 3, 1998

[54] TREEHOUSE PLAY SET WITH ELEVATOR PLATFORM AND EXTENDABLE BRANCH MEMBERS

[75] Inventors: Gregory R. Horton, Manville; James Cartabiano, Cumberland; Nancy Lavey, Wakefield, all of R.I.

[73] Assignee: Hasbro, Inc., Pawtucket, R.I.

[21] Appl. No.: 707,837

[22] Filed: Sep. 9, 1996

[51] Int. Cl.[6] ..... A63H 33/00

[52] U.S. Cl. ..... 446/476

[58] Field of Search ..... 446/476, 423; 434/276

[56] References Cited

U.S. PATENT DOCUMENTS

| | | | |
|---|---|---|---|
| 411,847 | 10/1889 | Weissenborn | 446/476 X |
| 618,810 | 1/1899 | Wood | 496/476 |
| 1,576,596 | 3/1926 | Gopf | 446/476 X |
| 2,817,924 | 12/1957 | Schrader | 446/476 X |
| 3,789,538 | 2/1974 | Spengler et al. | 496/423 X |
| 4,112,610 | 9/1978 | Sano | 446/423 |
| 4,139,967 | 2/1979 | Kuna et al. | 446/476 X |
| 4,161,081 | 7/1979 | Katzman et al. | 446/476 X |
| 4,291,488 | 9/1981 | Orenstein | 446/423 X |
| 4,458,440 | 7/1984 | D'Andrade et al. | 446/476 X |
| 4,654,011 | 3/1987 | Downs et al. | 434/276 |
| 4,781,643 | 11/1988 | Holloway et al. | 446/476 X |

*Primary Examiner*—William H. Grieb
*Attorney, Agent, or Firm*—Kurt R. Benson

[57] ABSTRACT

A treehouse play set for use with action figures includes a tree-shaped base having a hollow trunk portion and a treehouse platform attached to the trunk portion, and further includes an elevator which is slidably movable on the exterior surface of the trunk portion between a first lowered position wherein the elevator is adjacent a supporting surface and a second raised position wherein the elevator is generally co-planar with the treehouse platform. The play set further includes a tree-growing mechanism disposed within the trunk portion to simulate growing action of the tree when the elevator is moved from the lowered position to the raised position. The tree growing mechanism includes a plurality of elongate branch members which are attached to the top portion of a piston which is slidably received within the trunk portion of the base. The piston is slidably movable within the trunk portion between a first lowered position wherein the branch members are generally disposed within the trunk portion, and a second raised position wherein the branch members extend upwardly and outwardly from the upper end of the trunk portion. The elevator is coupled to the piston wherein movement of the elevator between the lowered and raised positions causes corresponding movement of the piston between the lowered and raised positions.

10 Claims, 5 Drawing Sheets

TREEHOUSE PLAY SET WITH ELEVATOR PLATFORM AND EXTENDABLE BRANCH MEMBERS

BACKGROUND AND SUMMARY OF THE INVENTION

The instant invention relates to play sets for action figures, and more particularly to a treehouse play set including a treehouse, treehouse elevator, and extendable branches which are raised and lowered with the treehouse elevator to simulate a growing action of the tree.

Play sets including elevator mechanisms have heretofore been known in the art. In this regard, the Schrader U.S. Pat. No. 2,817,924 and Katzman et al Pat. No. 4,161,081 represent the closest prior art to the subject invention of which the applicant is aware. More specifically, the patent to Schrader discloses a multi-storied building having an elevator assembly which is operated by pulling a ring to operate a string to raise and lower the elevator. The patent to Katzman et al discloses a play set in the form of a two-story house which folds in a case. The house includes an elevator shaft formed in the hinge portion of the case, and a manually operated elevator car movable between the upper and lower floors of the house. While the above-noted play sets are effective and have significant play value for children, there is nevertheless an ongoing need and consumer desire for new and unique play sets for children.

The instant invention provides a treehouse play set for use with action figures comprising a tree-shaped base having a hollow trunk portion and a treehouse platform attached to the trunk portion, and further comprising an elevator which is slidably movable on the exterior surface of the trunk portion between a first lowered position wherein the elevator is adjacent a supporting surface, and a second raised position wherein the elevator is generally co-planar with the treehouse platform. The play set further includes a tree-growing mechanism disposed within the trunk portion to simulate growing action of the tree when the elevator is moved from the lowered position to the raised position. The tree growing mechanism includes a plurality of elongate branch members which are attached to the top portion of a piston which is slidably received within the trunk portion of the base. The branch members include a plurality of simulated leaves on the terminal ends thereof to enhance the appearance of the tree and the growing action. The piston is slidably movable within the trunk portion between a first lowered position wherein the branch members are generally disposed within the trunk portion, and a second raised position wherein the branch members extend upwardly and outwardly from the upper end of the trunk portion. The elevator is coupled to the piston by an arm which extends through a vertical slot in the outer wall of the trunk portion.

In use, movement of the elevator between the lowered and raised positions causes corresponding movement of the piston between the lowered and raised positions and longitudinal movement of the branch members inwardly and outwardly from the upper end of the trunk portion.

The trunk portion of the base further includes an aperture therein, and the piston includes a picture of an animal, such as a squirrel, which might be living in a hole in the tree. The picture is hidden when the piston is in the lowered position. However, when the piston is moved to the raised position, the picture aligns with the aperture and is visible through the aperture.

Accordingly, among the objects of the instant invention are: the provision of a treehouse play set including a tree, a treehouse platform on the tree, and an elevator which moves between raised and lowered positions to simulate movement of action figures from the ground to a treehouse platform; and the provision of such a treehouse play set including a tree growing mechanism wherein branch members of the tree are coupled to the elevator mechanism so that when the elevator is moved to the raised position, the branch members are extended upwardly and outwardly from the top end of the trunk to simulate a growing action Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
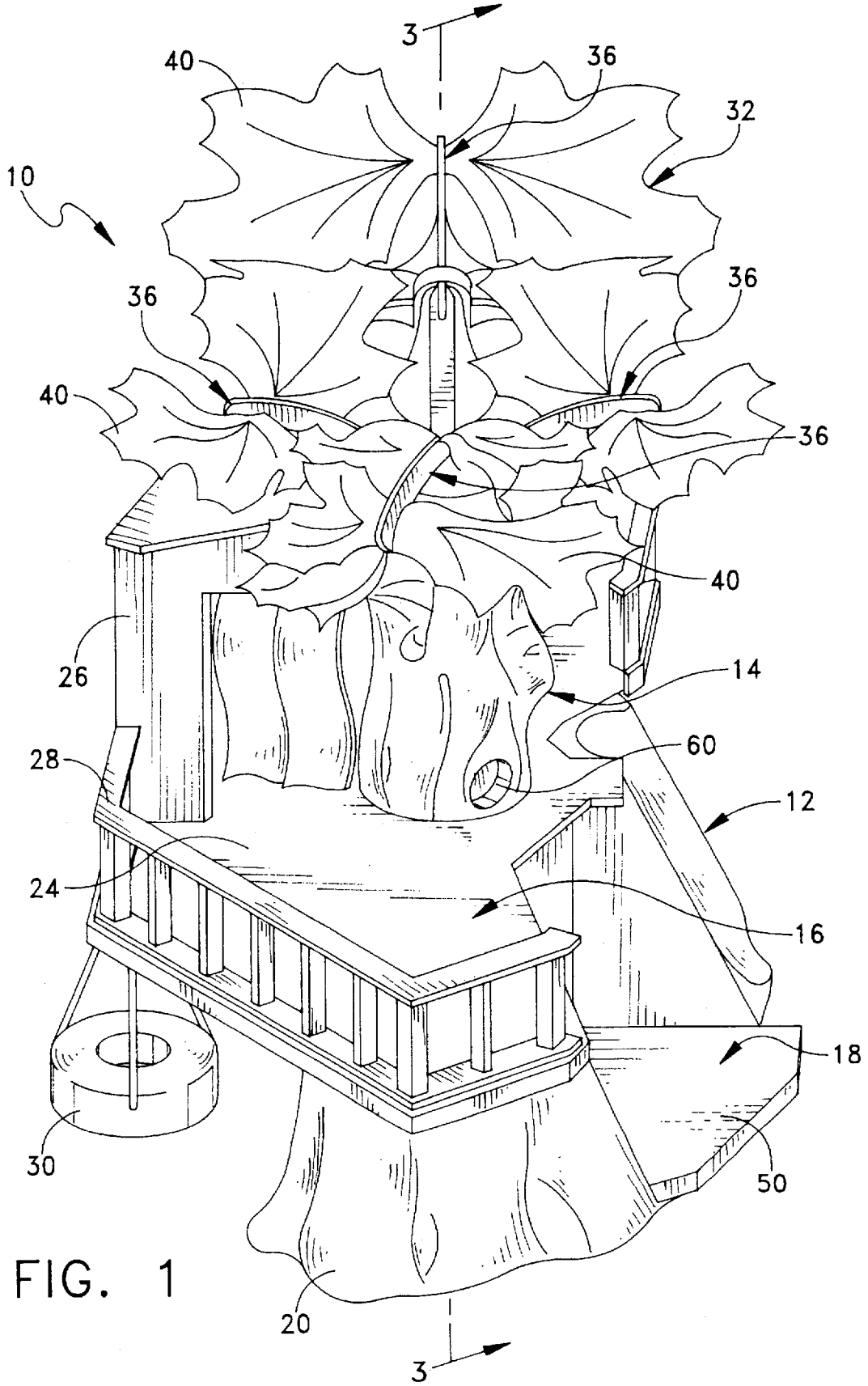
FIG. 1 is a perspective view of the play set with the elevator in the lowered position.

Referring now to the drawings, the treehouse play set of the instant invention is illustrated and generally indicated at 10 in FIGS. 1–5. As will hereinafter be more fully described, the instant invention provides a treehouse play set 10 for use with action figures (not shown) comprising a tree-shaped base generally indicated at 12 having a hollow trunk portion generally indicated at 14 and a treehouse platform generally indicated at 16 attached to the trunk portion 14. The play set 10 further comprises an elevator generally indicated at 18 which is slidably movable on the exterior surface of the trunk portion 14 between a first lowered position (FIG. 1) wherein the elevator 18 is adjacent a supporting surface and a second raised position (FIG. 2) wherein the elevator 18 is generally co-planar with the treehouse platform 16.

The entire base portion 12 is preferably molded from plastic materials wherein the external surface of the trunk portion is contoured to resemble the outer surface of a tree. The trunk portion 14 includes a lower root end 20 dsiposed below the treehouse platform 16 which is adapted for supporting the base 12 on a supporting surface, and further includes an upper end 22 disposed above the treehouse platform 16. The treehouse platform 16 includes a planar deck area 24 which is parallel to the supporting surface, and further includes a treehouse structure 26 in which the action figures can be placed during play. The deck area 24 includes side rail structures 28 to further enhance the realistic look of the treehouse structure 26. Even further still, the deck 24 is provided with a simulated tire swing 30 hanging from the lower surface thereof.

Figure 2:
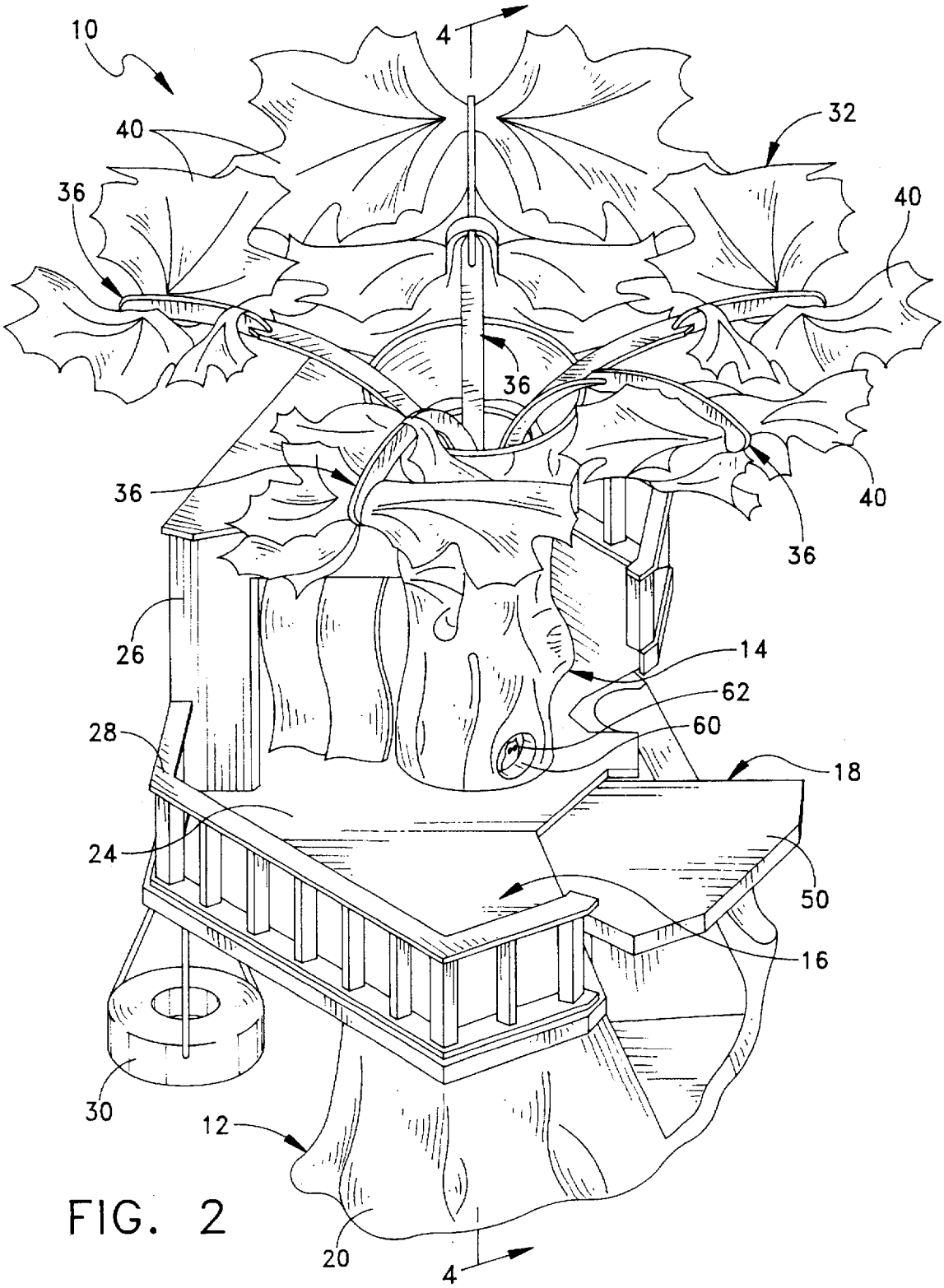
FIG. 2 is another perspective view thereof with the elevator in the raised position.
Figure 3:
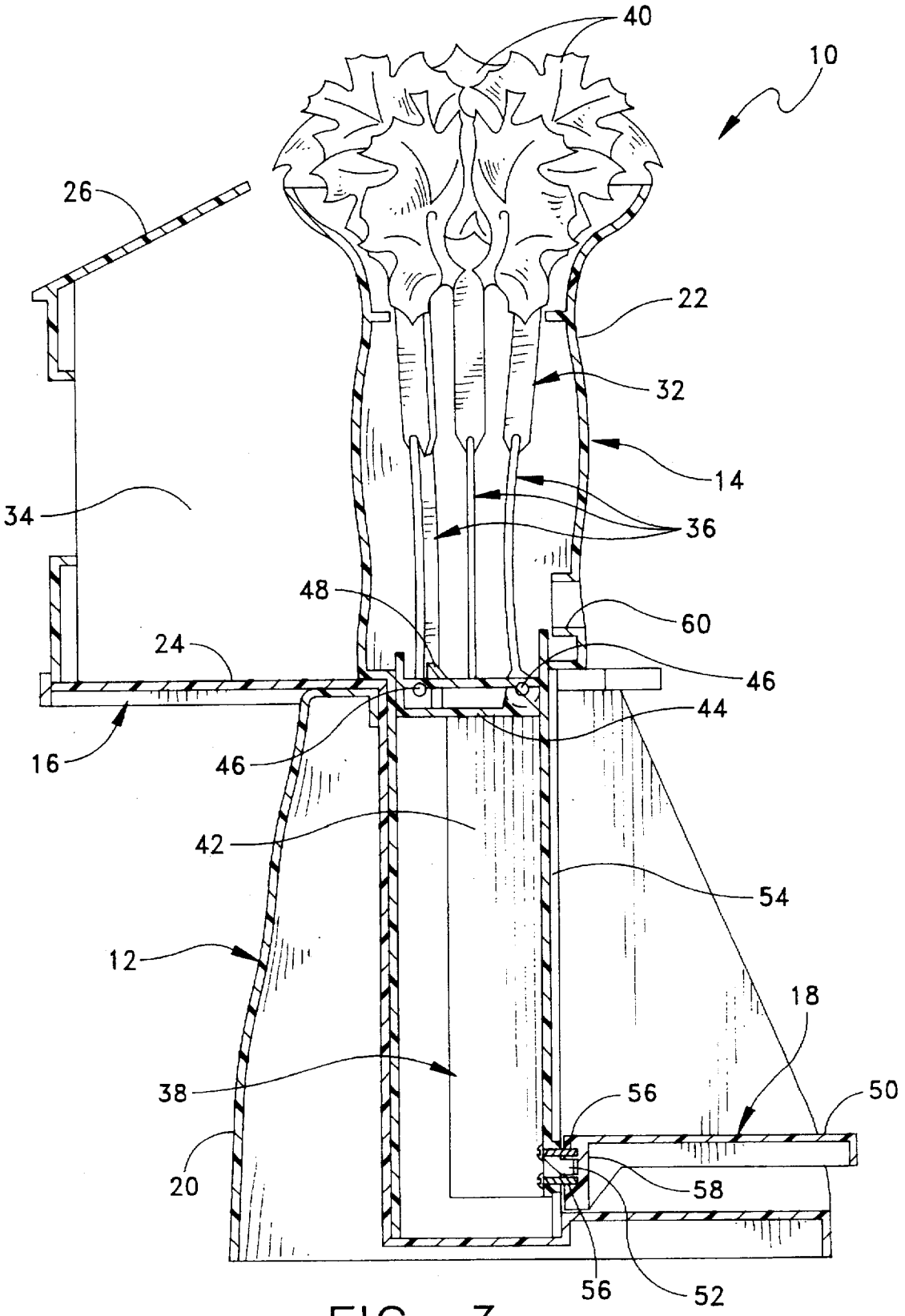
FIG. 3 is cross-sectional view thereof taken along line 3—3 of FIG. 1.
Figure 4:
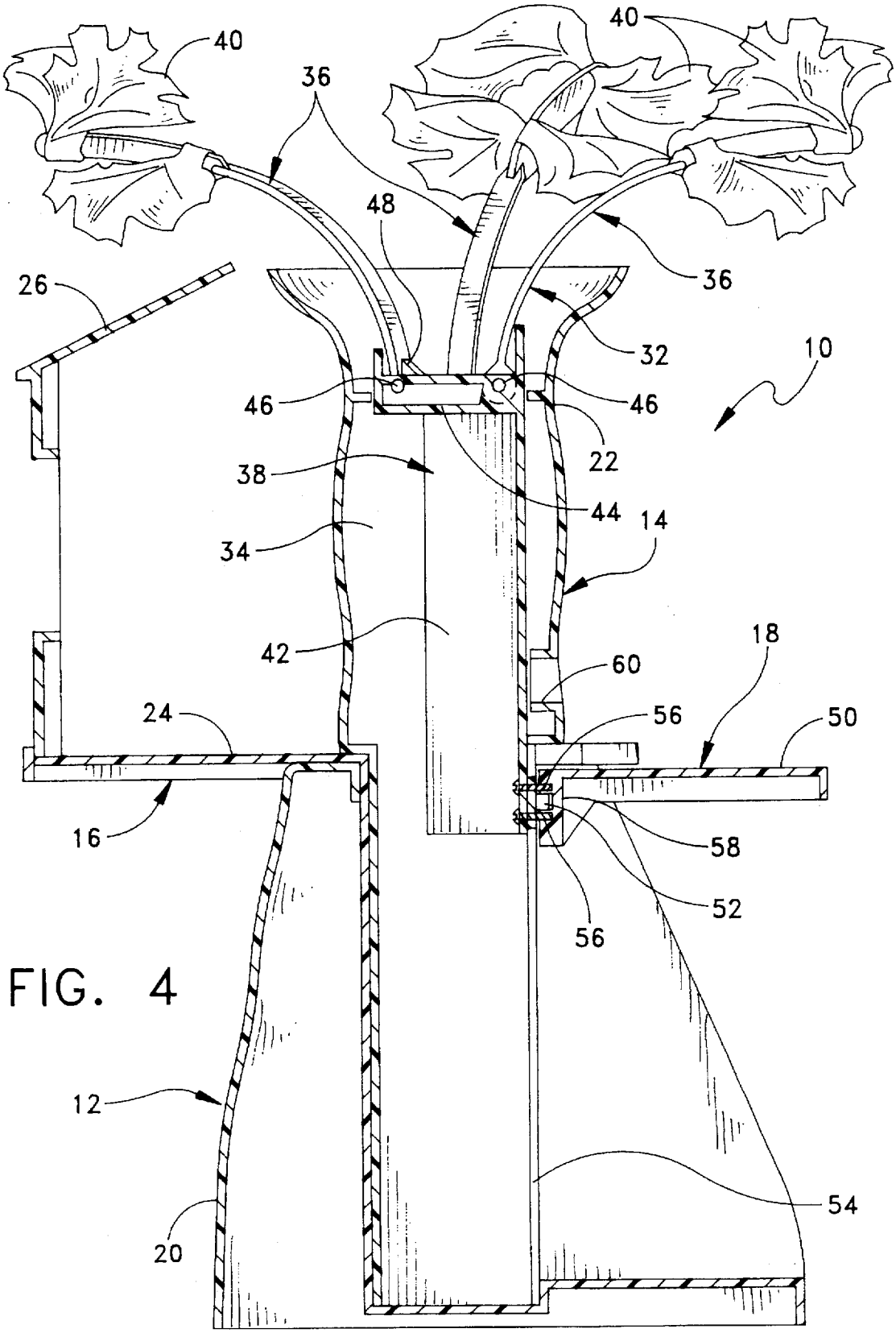
FIG. 4 is a cross-sectional view thereof taken along line 4—4 of FIG. 2.

The play set 10 further includes a tree-growing mechanism generally indicated at 32 (FIGS. 2 and 4) which is disposed within a hollow interior column 34 extending vertically within the trunk portion 14. The tree growing mechanism 32 is operative for simulating a growing action of the tree 12 when the elevator 18 is moved from the lowered position (FIG. 1) to the raised position (FIG. 2). More specifcally, the tree growing mechanism 32 includes a plurality of elongate branch members generally indicated at 36 which are disposed longitudinally within the trunk portion 14 and attached to the top portion of a piston generally indicated at 38 which is slidably received within the trunk portion 14. The branch members 36 include simulated leaves 40 on the terminal ends thereof to enhance the appearance of the tree 12 and the growing action. The piston 38 includes an elongate body portion 42 which is slidably movable within the trunk portion 14 between a first lowered position (FIG. 3) wherein the branch members 36 are generally disposed within the upper end 22 of the trunk portion 14, and a second raised position (FIG. 4) wherein the branch members 36 extend upwardly and outwardly from the upper end 22 of the trunk portion 14. The branch members 36 are pivotally attached to a head portion 44 of the piston 38 by means of pins 46 which are received into corresponding C-shaped locking tabs 48 on the upper surface of the piston head 44. When the piston 38 is moved to the raised position (FIG. 4) and the branch members 36 are correspondingly moved longitudinally upwardly, the pivot connection between the branch members 36 and the piston head 44 permits the branch members 36 to extend radially outwardly as well as upwardly, and thereby more realistically simulate the shape of an actual tree.

The elevator 18 comprises a horizontally disposed platform 50 which is connected to an arm portion 52 of the piston 38 extending through a vertical slot 54 in the outer wall of the lower end 20 of the trunk portion 14. The elevator platform 50 is conneced to the arm portion 52 of the piston 38 by means of screws 56 which extend through the piston body 42, through the slot 54, and into the side portion 58 of the elevator platform 50 which faces the trunk portion 14 of the base 12.

In use, movement of the elevator 18 between the lowered and raised positions causes corresponding movement of the piston 38 between the lowered and raised positions and longitudinal movement of the branch members 36 inwardly and outwardly from the upper end 22 of the trunk portion 14.

Figure 5:
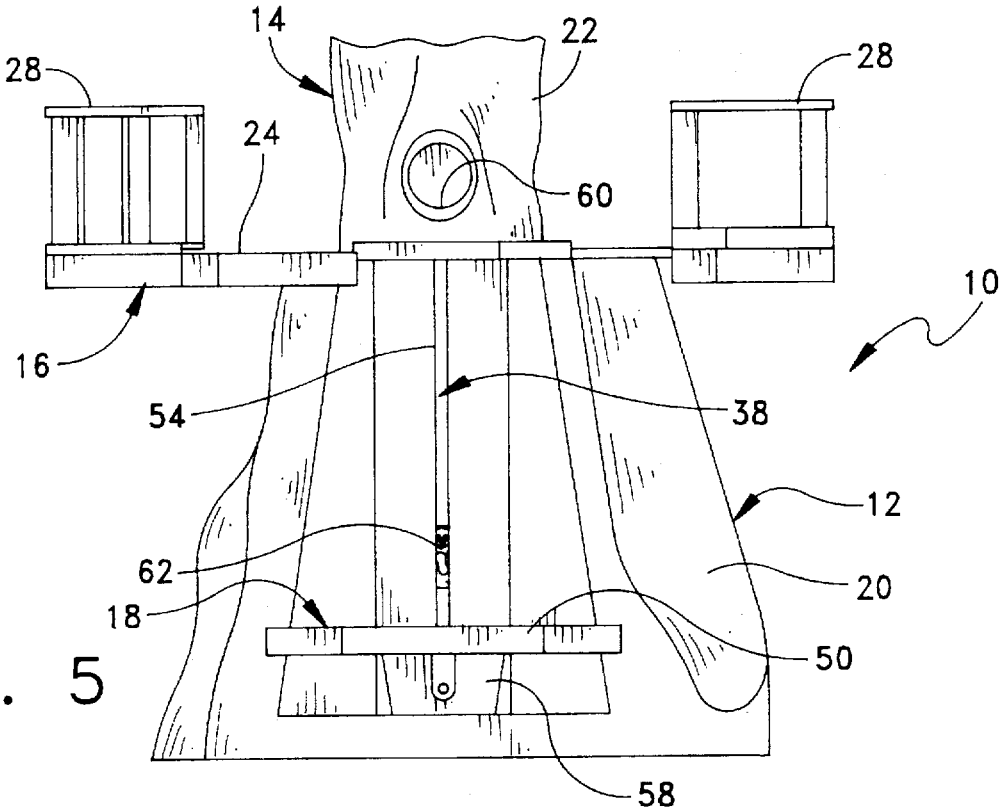
FIG. 5 is a fragmented front view thereof with the elevator in the lowered position.
Figure 6:
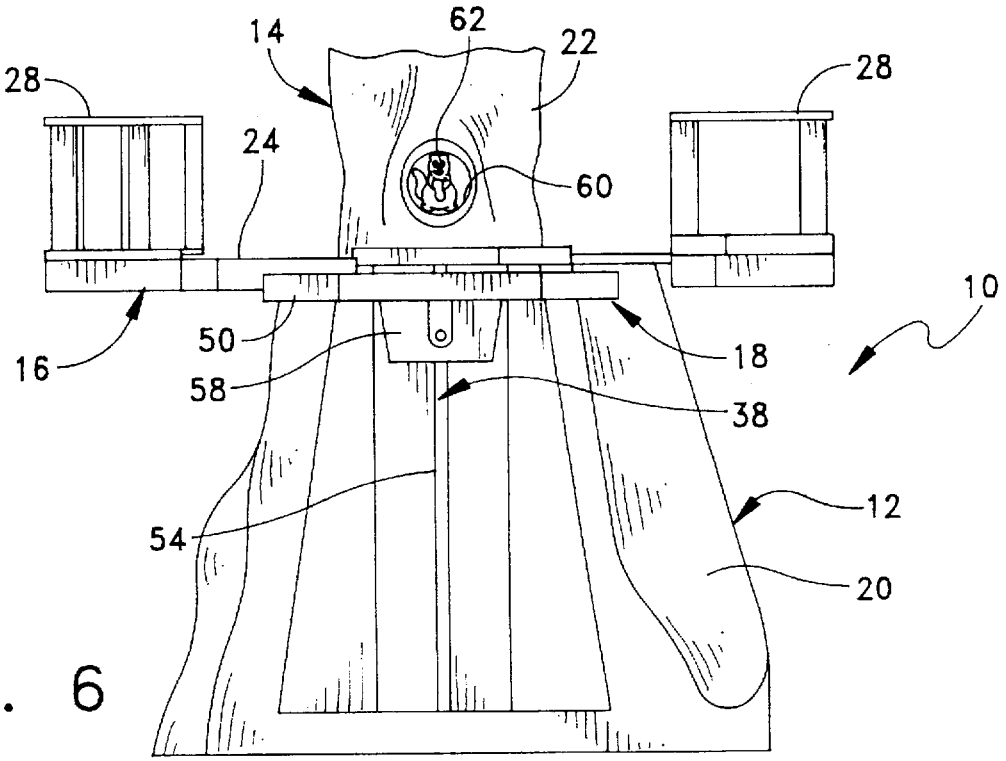
FIG. 6 is a fragmented front view thereof with the elevator in the raised position.

The upper end 22 of the trunk portion 14 further includes an aperture 60 therein, and the body 42 of the piston 38 includes a graphical picture 62 of an animal, such as a squirrel, which might be living in a hole in the tree. Referring to FIGS. 1, and 5, the picture 62 is hidden when the piston 38 is in the lowered position. However, when the piston 38 is moved to the raised position (FIGS. 2, and 6), the picture 62 aligns with the aperture 60 and is visible through the aperture 60.

It can therefore be seen that the instant invention provides a play set 10 which has several new and unique interactive features. The treehouse elevator 18 is operative for movement of action figures between the ground and the treehouse platform 16 such that children using the play set can effectively interact with the play set 10. The treehouse play set 10 further includes a treehouse structure 26 in which the action figures can be placed during play thereby further enhancing the interactive play value of the play set 10. Still further the play set 10 includes a tree growing mechanism 32 which simulates a growing action of the tree. The tree growing mechanism 32 is automatically operative with the elevator platform 18 to extend simulated tree branches 36 when the elevator platform is moved from a lowered position to a raised position. For these reasons, the instant invention is believed to represent a significant advancement in the art which has substantial commercial merit and play value.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A play set for use with action figures comprising:

a base including a generally upright column having upper and lower ends, and a platform attached to the column between the upper and lower ends thereof;

a piston received within said column;

an extension member attached to a top portion of said piston, said piston being slidably movable within said column between a first lowered position wherein said extension member is generally disposed within said column, and a second raised position wherein said extension member extends upwardly and outwardly from the upper end of said column; and an elevator which is slidably movable on the exterior surface of said column between a first lowered position wherein said elevator is adjacent a supporting surface and a second raised position wherein said elevator is generally co-planar with said platform, said elevator being coupled to said piston wherein movement of said elevator between said first and second positions causes corresponding movement of said piston between said first and second positions.

2. A play set for use with action figures comprising:

a tree-shaped base including a hollow trunk portion having upper and lower ends, and a treehouse platform attached to the trunk portion between the upper and lower ends thereof;

a plurality of elongate branch members longitudinally disposed within said trunk portion, said branch members being slidably movable within said trunk portion between a first lowered position wherein said branch members are generally disposed within said trunk portion, and a second raised position wherein said branch members extend upwardly and outwardly from the upper end of said trunk portion; and an elevator which is slidably movable on the exterior surface of said trunk portion between a first lowered position wherein said elevator is adjacent a supporting surface and a second raised position wherein said elevator is generally co-planar with said treehouse platform, said elevator being coupled to said branch members wherein movement of said elevator between said first and second positions causes corresponding movement of said branch members between said first and second positions.

3. A play set for use with action figures comprising:

a tree-shaped base including a hollow trunk portion having upper and lower ends, and a treehouse platform attached to the trunk portion between the upper and lower ends thereof;

a piston received within said trunk portion;

a plurality of elongate branch members attached to a top portion of said piston, said piston being slidably movable within said trunk portion between a first lowered position wherein said branch members are generally disposed within said trunk portion, and a second raised position wherein said branch members extend upwardly and outwardly from the upper end of said trunk portion; and an elevator which is slidably movable on the exterior surface of said trunk portion between a first lowered position wherein said elevator is adjacent a supporting surface and a second raised position wherein said elevator is generally co-planar with said treehouse platform, said elevator being coupled to said piston wherein movement of said elevator between said first and second positions causes corresponding movement of said piston between said first and second positions.

4. The play set of claim 3 wherein each said branch members include a plurality leaves attached thereto.

5. The play set of claim 3 wherein said branch members are pivotally attached to the top portion of said piston.

6. The play set of claim 4 wherein said branch members are pivotally attached to the top portion of said piston.

7. The play set of claim 3 wherein said trunk portion includes an aperture therein, and said piston includes a picture of character, said picture being hidden when said piston is in one of said first and second position, and said picture being visible when said piston is in the other of said first and second positions.

8. The play set of claim 4 wherein said trunk portion includes an aperture therein, and said piston includes a picture of character, said picture being hidden when said piston is in one of said first and second position, and said picture being visible when said piston is in the other of said first and second positions.

9. The play set of claim 5 wherein said trunk portion includes an aperture therein, and said piston includes a picture of character, said picture being hidden when said piston is in one of said first and second position, and said picture being visible when said piston is in the other of said first and second positions.

10. The play set of claim 6 wherein said trunk portion includes an aperture therein, and said piston includes a picture of character, said picture being hidden when said piston is in one of said first and second position, and said picture being visible when said piston is in the other of said first and second positions.

* * * * *